United States Patent [19]

Boy

[11] Patent Number: 5,012,545

[45] Date of Patent: May 7, 1991

[54] ROTARY CLEANING AND POLISHING PAD

[76] Inventor: Max W. Boy, 4651 Bartow Carver Rd., Acworth, Ga. 30101

[21] Appl. No.: 470,705

[22] Filed: Jan. 26, 1990

[51] Int. Cl.[5] ..... B24B 29/00

[52] U.S. Cl. ..... 15/230.12; 15/230; 15/230.14; 15/230.16

[58] Field of Search ..... 15/230, 230.12, 230.14, 15/230.16, 98; 51/394, 395, 397, 401, 407

[56] References Cited

U.S. PATENT DOCUMENTS

| | | | |
|---|---|---|---|
| 291,610 | 1/1884 | Levett | 15/230 |
| 760,080 | 5/1904 | Racicot et al. | 15/230.14 |
| 1,216,488 | 2/1917 | Pfeiffer | 15/230 |
| 3,164,855 | 1/1965 | Hencken | 15/230 |
| 3,243,833 | 4/1966 | Hencken | 15/230.16 |
| 4,536,911 | 8/1985 | Demetriades | 15/230.12 |
| 4,724,567 | 2/1988 | Rones | 15/230.16 |

*Primary Examiner*—Edward L. Roberts
*Attorney, Agent, or Firm*—Rodgers & Rodgers

[57] ABSTRACT

A rotary cleaning and polishing pad is provided and comprises a pair of fibrous layers adhered in face contacting relation, each of the layers comprising multiple segments, each segment having V-shaped side edges, a side edge of one segment in each layer being in face contacting relation with a side edge of an adjoining segment to form a seam in each layer, and the seam of one layer being laterally offset from the seam of the other layer.

7 Claims, 2 Drawing Sheets

ROTARY CLEANING AND POLISHING PAD

BACKGROUND OF THE INVENTION

Rotary cleaning and polishing pads of varying designs are well known in the art. Examples of such pads are disclosed in the following United States patents:

| | |
|---|---|
| 1,640,032 Fiechter | 4,418,438 Cutler |
| 1,673,160 Ross | 4,502,174 Rones |
| 3,462,889 Erickson | 4,701,970 Wilson |
| 3,703,739 Young et al | 4,709,439 Warren et al |
| 4,724,567 Rones | |

During the manufacturing process of known pads, it is customary to cut an entire pad from a sheet of fibrous material. Since the typical pad is circular in configuration, the material disposed between the edge of the pad and the edges of the sheet of fibrous material is unutilized. Obviously this causes a tremendous waste control problem for the manufacturer.

SUMMARY OF THE INVENTION

By this invention, a rotary and cleaning pad is provided and comprises a pair of layers, each layer comprising multiple segments with each segment having a pair of noncurved edges, an edge of one segment in abutting relationship with an edge of the joining segment to form a seam, and the seam of one layer being offset laterally from the seam of the other layer.

DESCRIPTION OF THE PREFERRED EMBODIMENT

Figure 1:
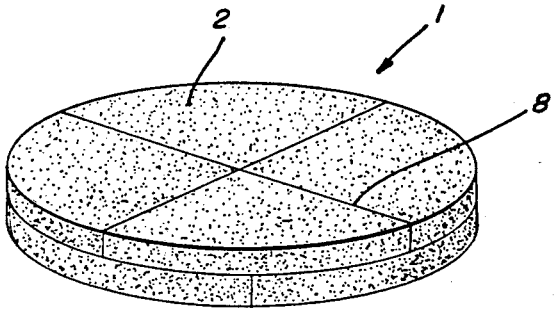
FIG. 1 is a perspective view of a rotary cleaning and polishing pad formed according to this invention.

In the drawings, the numeral 1 generally designates the cleaning and polishing pad for use in connection with conventional propane gas floor pad machines and electric floor polishing machines. Pad 1 comprises multiple segments 2. Each segment 2 has a pair of noncurved side edges 3 and 4 as well as curved edge 5 and the segments 2 are stamped or cut, in known fashion from an elongated layer of fibrous material 6. If desired, any suitable abrasive material may be embedded in one or both surfaces of pad 1 in order to enhance the cleaning action of the pad. Of course, when one surface of pad 1 is worn out, the pad is simply turned over and the other surface is utilized in the normal manner.

Figure 2:
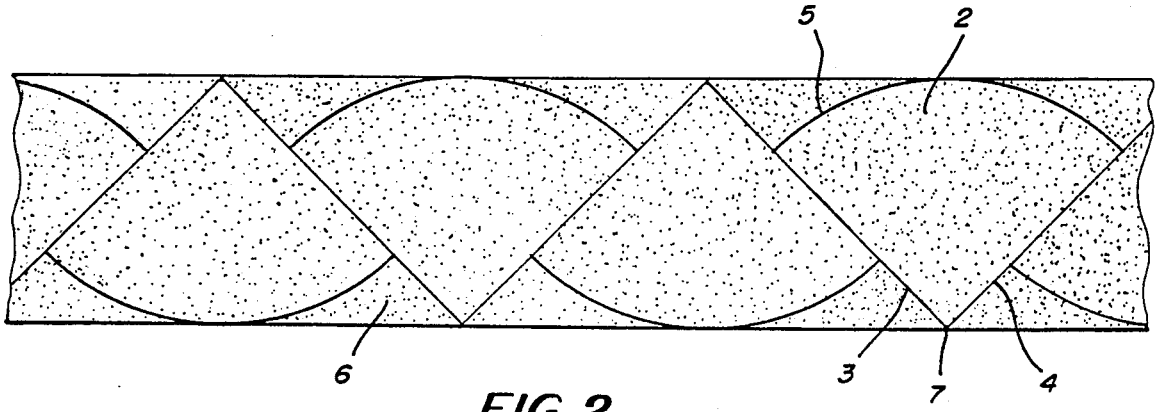
FIG. 2 is a plan view of multiple pad segments disposed in a nested relationship on a strip of fibrous material.
Figure 3:
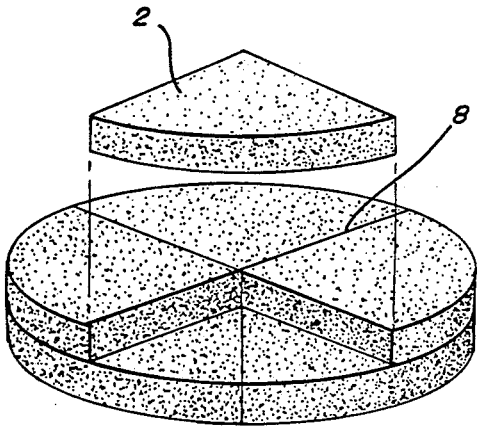
FIG. 3 is a partially exploded view similar to FIG. 1.

In order to form a rotary cleaning and polishing pad according to this invention, segments 2 are cut from a strip of fibrous material 6 by means of an appropriate manufacturing die in such manner that segments 2 are disposed in a nested fashion on fibrous material 6 as shown in FIG. 2. Following this, four individual segments 2 are placed in side by side relation such that apexes 7 of segments 2 are in general coincidental relationship with each other to form a layer. Of course, a layer of material 6 could comprise any number of multiple individual segments.

Figure 4:
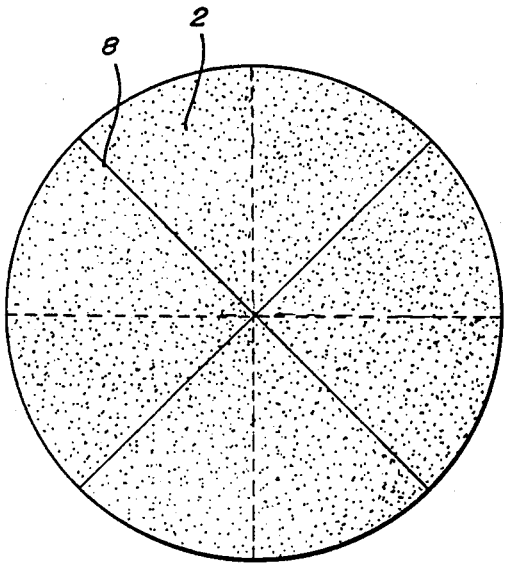
FIG. 4 is a top plan view of the pad as shown in FIG. 1.

Then an application of adhesive material is made to the exposed upper surface of the layer. Then a second layer is formed in the same way as discussed above in connection with the first layer which is then placed on the first layer in a staggered fashion such that seams 8 of one layer are rotated and spaced laterally from the associated seams in the lower layer. As best shown in FIG. 4, each seam 8 in the upper layer essentially bisects the associated segment 2 in the lower layer. Of course, seam 8 of one layer can be spaced essentially laterally any amount from the associated seam 8 in the other layer. Obviously this invention will not be operable if seams 8 of one layer are in general coincidence with seams 8 in the other layer.

Figure 5:
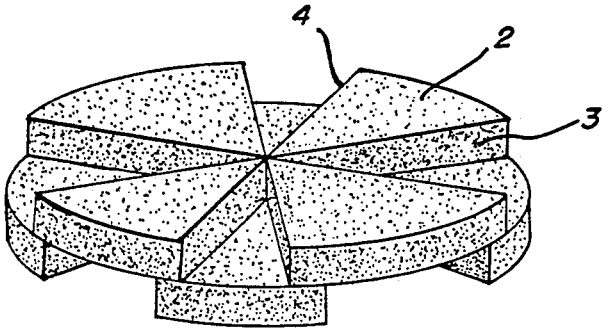
FIG. 5 is a perspective view of a modified form of the invention.
Figure 6:
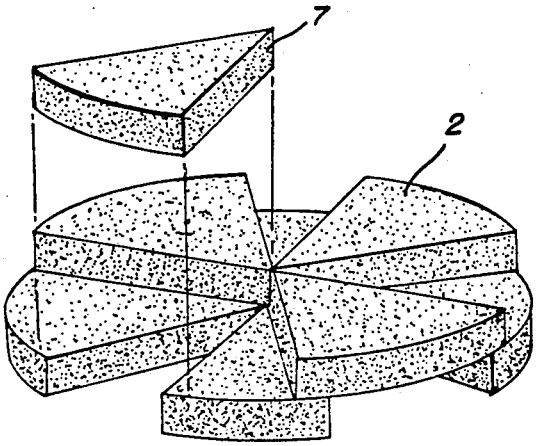
FIG. 6 is a partially exploded view similar to FIG. 5.
Figure 7:
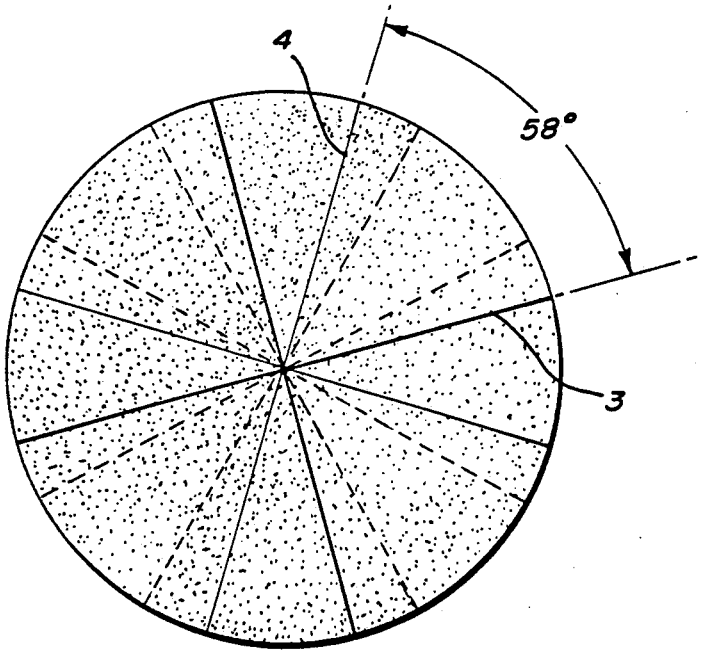
FIG. 7 is a top plan view of the pad as shown in FIG. 5.

A modified form of the invention is shown in FIGS. 5, 6 and 7 wherein pad 1 is formed in a fashion similar to that shown in connection with FIGS. 1–4 except that side edges 3 and 4 of each segment 2 are spaced from the associated side edges of an adjacent segment. By this means, obviously a substantial savings in material is accomplished although the total amount of pad material is reduced. It has been determined that in order to properly nest segments 2 of the modified pad on the sheet of fibrous material 6, V-shaped side edges 3 and 4 should form an angle of 58 degrees although the angle may vary to get the best yield out of the fibrous material.

Therefore, by this invention, an improved rotary cleaning and polishing pad is provided which is economical to manufacture and can be made from a sheet of fibrous material which is half the thickness as conventional pad material. In addition, the pad can be made of synthetic, natural fibers or a combination thereof.

I claim:

1. A rotary floor cleaning and polishing pad of nonwoven fibrous material comprising a pair of layers, each of said layers comprising multiple discrete segments, each of said segments having an outer edge and a pair of side edges, said layers being adhered in flat face contacting relation, and each segment of one layer overlying adjacent side edges in the other layer.

2. A pad according to claim 1 wherein said side edges are V-shaped.

3. A pad according to claim 1 where abrasives are imbedded in the surface of at least one layer opposite the adhered surface.

4. A pad according to claim 1 wherein said segments are adapted to be nested on an elongated sheet of fibrous material.

5. A pad according to claim 1 wherein said pad is manufactured of synthetic fibrous material.

6. A pad according to claim 1 wherein the side edges of adjacent segments in at least one of said layers are spaced from each other.

7. A pad according to claim 6 wherein one side edge of one segment forms an angle of approximately 58 degrees with the other side edge of the same segment.

* * * * *